US008059035B2

(12) United States Patent
Chang et al.

(10) Patent No.: US 8,059,035 B2
(45) Date of Patent: Nov. 15, 2011

(54) ANTENNA STRUCTURE CAPABLE OF INCREASING ITS FREQUENCY BANDWIDTH/FREQUENCY BAND BY BENDING A CONNECTION ELEMENT THEREOF

(75) Inventors: Cheng-Wei Chang, Taipei Hsien (TW); Shen-Pin Wei, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 298 days.

(21) Appl. No.: 12/464,889

(22) Filed: May 13, 2009

(65) Prior Publication Data

US 2010/0220014 A1 Sep. 2, 2010

(30) Foreign Application Priority Data

Feb. 27, 2009 (TW) ..... 98203007 U

(51) Int. Cl.
*H01Q 1/38* (2006.01)

(52) U.S. Cl. ..... 343/700 MS; 343/848

(58) Field of Classification Search ..... 343/700 MS, 343/702, 848

See application file for complete search history.

(56) References Cited

U.S. PATENT DOCUMENTS 6,864,841 B2 * 3/2005 Dai et al. ..... 343/700 MS
2006/0279464 A1 * 12/2006 Mei ..... 343/700 MS

* cited by examiner

*Primary Examiner* — Tan Ho
(74) *Attorney, Agent, or Firm* — Winston Hsu; Scott Margo

(57) ABSTRACT

An antenna structure consists of a radiation element, a grounding element, a short element, a connection element, and a signal feeding element. The short element is coupled between the radiation element and the grounding element. The connection element is disposed between the radiation element and the grounding element. The connection element has at least a first segment and a second segment, wherein the first segment and the second segment form a bend. The signal feeding element is coupled between the connection element and the grounding element. The first segment of the connection element is substantially parallel to the grounding element and is at a designated distance from the grounding element.

21 Claims, 14 Drawing Sheets

| Frequency | Maximum value | Position | Minimum value | Position | Average value |
|---|---|---|---|---|---|
| 3168(MHz) | 4.48dB | 294.00deg | -11.36dB | 159.00dge | -2.12dB |
| 3300(MHz) | 4.42dB | 294.00deg | -12.43dB | 57.00dge | -2.18dB |
| 3432(MHz) | 3.36dB | 294.00deg | -10.04dB | 51.00dge | -2.22dB |
| 3564(MHz) | 3.57dB | 249.00deg | -14.92dB | 81.00dge | -2.42dB |
| 3696(MHz) | 2.88dB | 249.00deg | -13.35dB | 141.00dge | -2.86dB |
| 3828(MHz) | 1.73dB | 249.00deg | -9.94dB | 54.00dge | -2.22dB |
| 3960(MHz) | 1.62dB | 252.00deg | -9.87dB | 144.00dge | -2.14dB |
| 4092(MHz) | 1.68dB | 252.00deg | -9.27dB | 87.00dge | -2.66dB |
| 4224(MHz) | 0.11dB | 357.00deg | -6.07dB | 114.00dge | -2.47dB |
| 4356(MHz) | 0.07dB | 30.00deg | -7.38dB | 84.00dge | -2.71dB |
| 4488(MHz) | 0.57dB | 6.00deg | -13.19dB | 90.00dge | -2.67dB |
| 4620(MHz) | 0.62dB | 3.00deg | -25.25dB | 75.00dge | -3.39dB |
| 4752(MHz) | 0.85dB | 180.00deg | -17.90dB | 72.00dge | -3.51dB |

FIG. 10

ANTENNA STRUCTURE CAPABLE OF INCREASING ITS FREQUENCY BANDWIDTH/FREQUENCY BAND BY BENDING A CONNECTION ELEMENT THEREOF

BACKGROUND OF THE INVENTION

1. Field of the Invention

The present invention relates to an antenna structure, and more particularly, to an antenna structure for increasing its frequency bandwidth/frequency band by bending a connection element of the antenna structure.

2. Description of the Prior Art

As wireless telecommunication develops with the trend of micro-sized mobile communication products, the location and the space arranged for antennas are limited. Therefore, some built-in micro antennas have been developed. Currently, micro antennas such as chip antennas, planar antennas etc are commonly used. All these antennas have the feature of small volume.

The planar antenna has the advantages of small size, light weight, ease of manufacturing, low cost, high reliability, and can also be attached to the surface of any object. Therefore, micro-strip antennas and printed antennas are widely used in wireless communication systems.

Due to multimedia applications of present wireless communication products, such as notebook computers, getting more and popular every day, transmissions with a large number of data has become a basic requirement of the wireless communication products. Thus requirements for operations at wide bandwidth get more basic. Therefore, how to improve antenna efficiency, adjust impedance matching, improve radiation patterns, and increase bandwidths of the antennas become important topics in this field.

SUMMARY OF THE INVENTION

It is one of the objectives of the present invention to provide an antenna structure to solve the abovementioned problems.

The present invention discloses an antenna structure. The antenna structure consists of a radiation element, a grounding element, a short element, a connection element, and a signal feeding element. The short element is coupled between the radiation element and the grounding element. The connection element is disposed between the radiation element and the grounding element. The connection element has at least a first segment and a second segment, wherein the first segment and the second segment form a bend. The signal feeding element is coupled between the connection element and the grounding element. The first segment of the connection element is substantially parallel to the grounding element and is at a designated distance from the grounding element.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 10 is a diagram showing the positions and the values of the maximum values, the minimum values, and the average values in FIG. 9.

DETAILED DESCRIPTION

Figure 1:
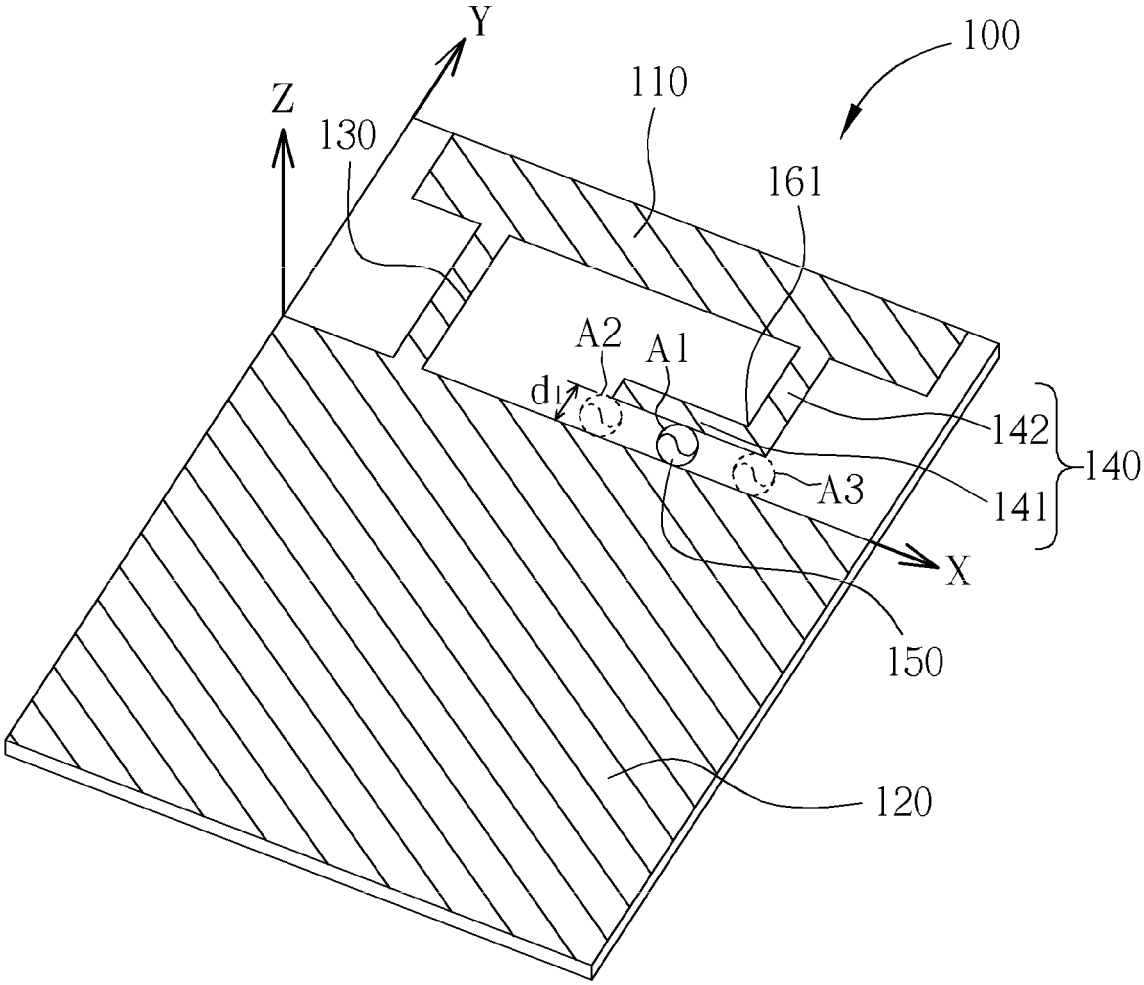
FIG. 1 is a diagram of an antenna structure according to a first embodiment of the present invention.

Please refer to FIG. 1. FIG. 1 is a diagram of an antenna structure 100 according to a first embodiment of the present invention. As shown in FIG. 1, the antenna structure 100 consists of a radiation element 110, a grounding element 120, a short element 130, a connection element 140, and a signal feeding element 150. The short element 130 is disposed between the radiation element 110 and the grounding element 120, and is coupled to the radiation element 110 as well as the grounding element 120. The connection element 140 is disposed between the radiation element 110 and the grounding element 120, and includes a plurality of segments forming at least one bend. In this embodiment, the connection element 140 has a first segment 141 and a second segment 142, wherein the first segment 141 and the second segment 142 form a bend 161. The first segment 141 of the connection element 140 is substantially parallel to the grounding element 120 and is at a designated distance d1 from the grounding element 120, wherein the designated distance d1 is approximately equal to 1.0~2.5 mm.

Furthermore, the signal feeding element 150 is coupled between the first segment 141 of the connection element 140 and the grounding element 120. In this embodiment, it is disposed in a location A1. Be noted that the location of the signal feeding element 150 is not unchangeable and can be moved to anywhere between locations A2 and A3 according to the arrow indicated in FIG. 1.

Figure 2:
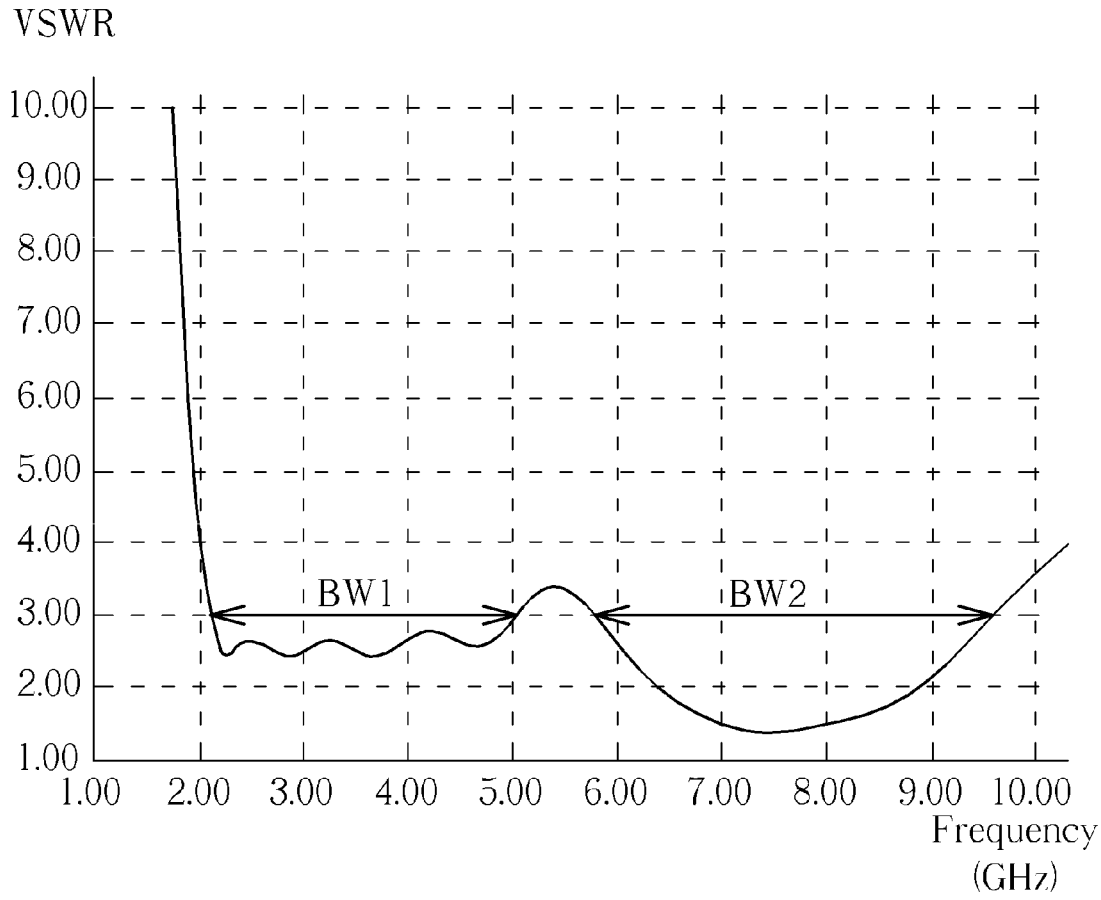
FIG. 2 is a diagram illustrating the VSWR of the antenna structure shown in FIG. 1.

Please refer to FIG. 2. FIG. 2 is a diagram illustrating the VSWR of the antenna structure 100 shown in FIG. 1. The horizontal axis represents frequency (GHz), between 1 GHz and 10 GHz, and the vertical axis represents the VSWR. As shown in FIG. 2, a first operating frequency band BW1 of the antenna structure 100 is from about 2.2 GHz to 5 GHz, and a second operating frequency band BW2 of the antenna structure 100 is from about 6 GHz to 9.5 GHz.

In this embodiment, the radiation element 110 resonates at an operating frequency band of lower frequency, e.g. the first operating frequency band BW1 shown in FIG. 1, wherein a length of the radiation element 110 is approximately one-fourth of a wavelength ($\lambda/4$) of a resonance mode generated by the antenna structure 100. In addition, by bending the connection element 140, a capacitance effect is formed between the first segment 141 of the connection element 140 and the grounding element 120 (i.e., the capacitance effect arising from the designated distance d1). Accordingly, another operating frequency band of higher frequency, e.g. the second operating frequency band BW2 shown in FIG. 2, can be additionally generated to increase the bandwidth of the antenna structure 100. Certainly, the designated distance d1 can be adjusted depending on actual demands.

Generally, if it is necessary to increase a new frequency band when designing an antenna, an extra radiator is required to resonate this desired frequency band. However, not only the size of the antenna is enlarged, but also the cost is raised. As for the antenna structure disclosed in the present invention, the goal of increasing the frequency band/frequency bandwidth can be achieved by bending the connection element 140. Besides, the antenna size and its cost can be effectively controlled.

Figure 3:
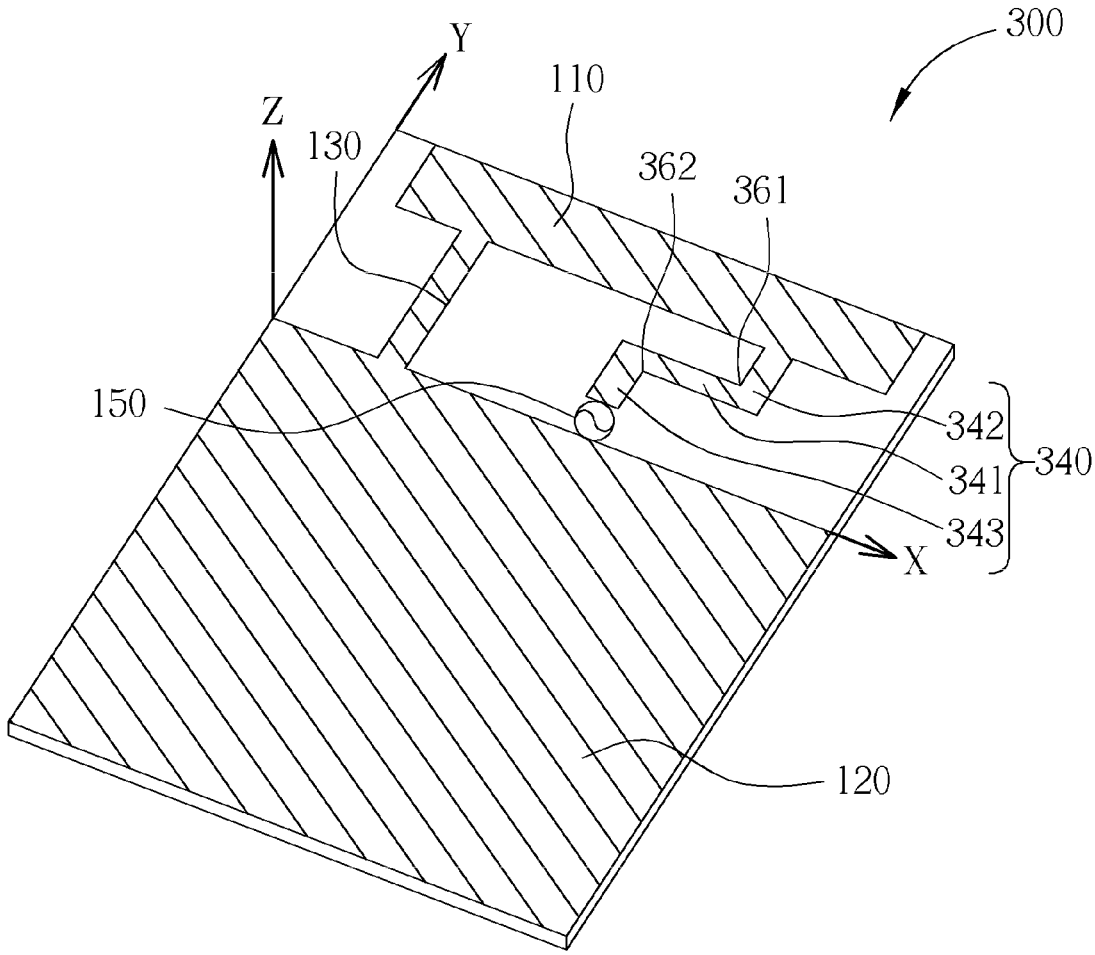
FIG. 3 is a diagram of an antenna structure according to a second embodiment of the present invention.

Please refer to FIG. 3. FIG. 3 is a diagram of an antenna structure 300 according to a second embodiment of the present invention, which is a changed form of the antenna structure 100 shown in FIG. 1. In FIG. 3, the architecture of the antenna structure 300 is similar to that of the antenna structure 100, and the difference between them is that a connection element 340 of the antenna structure 300 includes a first segment 341, a second segment 342, and a third segment 343, wherein the first segment 341 as well as the second segment 342 form a bend 361 while the first segment 341 as well as the third segment 343 form another bend 362. In other words, the plurality of segments 341~343 of the connection element 340 form a lightning shape.

Figure 4:
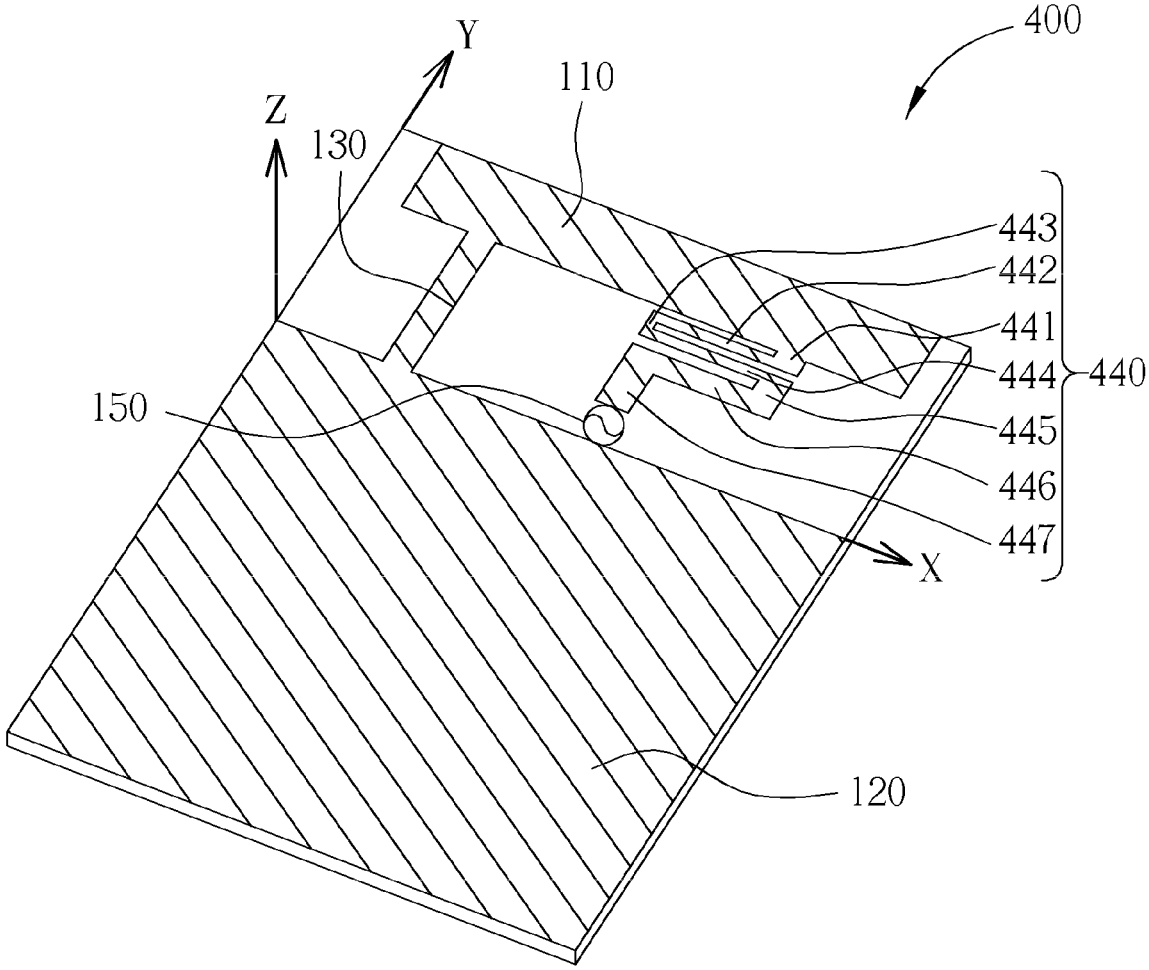
FIG. 4 is a diagram of an antenna structure according to a third embodiment of the present invention.

Be noted that the number of the bends included by the connection element is not limited. Please refer to FIG. 4. FIG. 4 is a diagram of an antenna structure 400 according to a third embodiment of the present invention. In this embodiment, a connection element 440 of the antenna structure 400 consists of seven segments 441~447 forming six bends.

Figure 5:
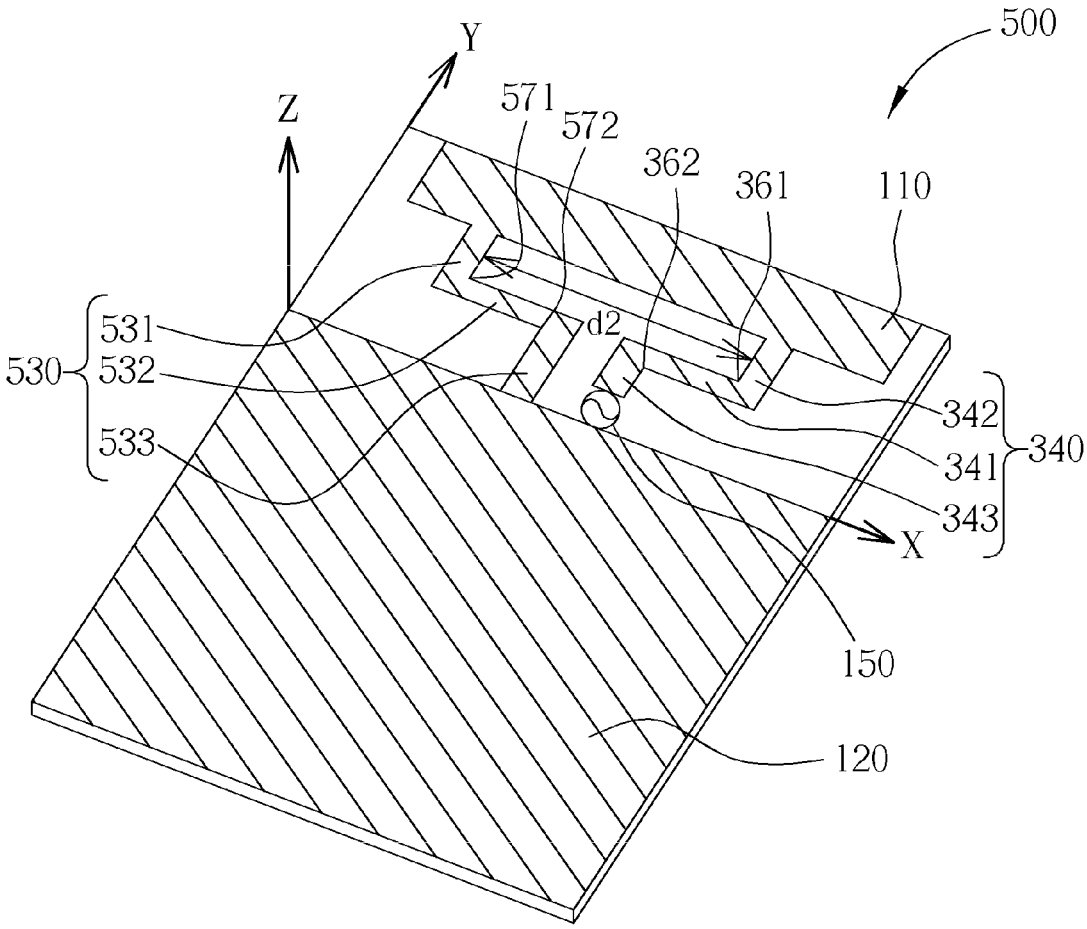
FIG. 5 is a diagram of an antenna structure according to a fourth embodiment of the present invention.

Please refer to FIG. 5. FIG. 5 is a diagram of an antenna structure 500 according to a fourth embodiment of the present invention, which is a changed form of the antenna structure 300 shown in FIG. 3. In FIG. 5, the architecture of the antenna structure 500 is similar to that of the antenna structure 300, and the difference between them is that a short element 530 of the antenna structure 500 further includes a plurality of segments 531~533 forming at least one bend 571 and 572. In this embodiment, the plurality of segments 341~343 included by the connection element 340 form a lightning shape while the plurality of segments 531~533 included by the short element 530 form another lightning shape. Please note that the second segment 342 of the connection element 340 is substantially parallel to the segment 531 of the short element 530 and is at a designated distance d2 from the segment 531. The designated distance d2 is related to the aforementioned first operating frequency band BW1, wherein the first operating frequency band BW1 can be adjusted by adjusting the designated distance d2.

Figure 6:
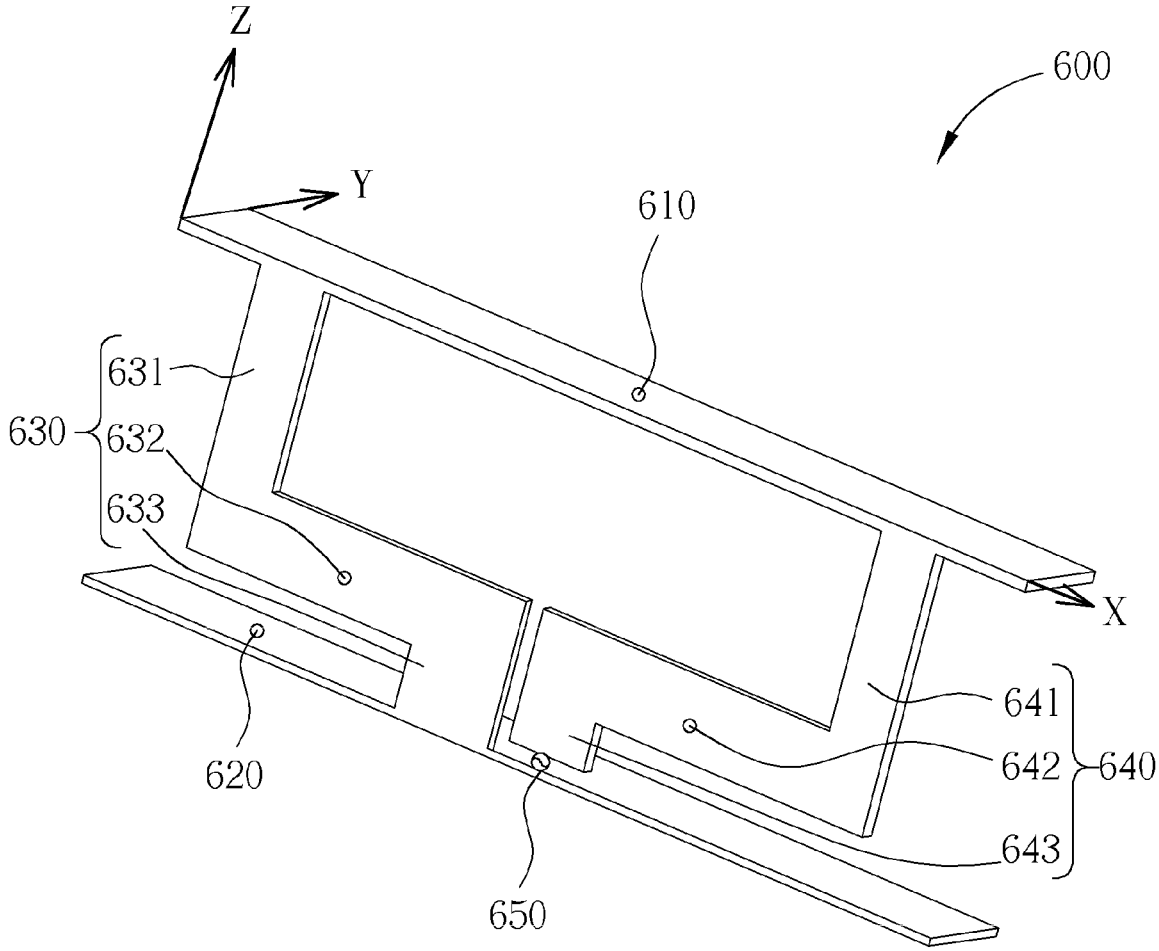
FIG. 6 is a diagram of an antenna structure according to a fifth embodiment of the present invention.

Please refer to FIG. 6. FIG. 6 is a diagram of an antenna structure 600 according to a fifth embodiment of the present invention, which is a changed form of the antenna structure 500 shown in FIG. 5. In FIG. 6, the architecture of the antenna structure 600 is similar to that of the antenna structure 500, and the difference between them is that each element of the antenna structure 600 presents a solid form and is located on different planes. For example, a radiation element 610 and a grounding element 620 are located on the XY plane, while a short element 630 (including segments 631~633), a connection element 640 (including segments 641~643), as well as a signal feeding element 650 are located on the YZ plane. On the contrary, the elements of the antenna structure 500 shown in FIG. 5 are located on an identical plane. As can be known, the locating plane of each element of the antenna structure should not be considered to be limitations of the scope of the present invention. Those skilled in the art should appreciate that various modifications of the locating plane of each element included by the antenna structure may be made without departing from the spirit of the present invention.

Figure 7:
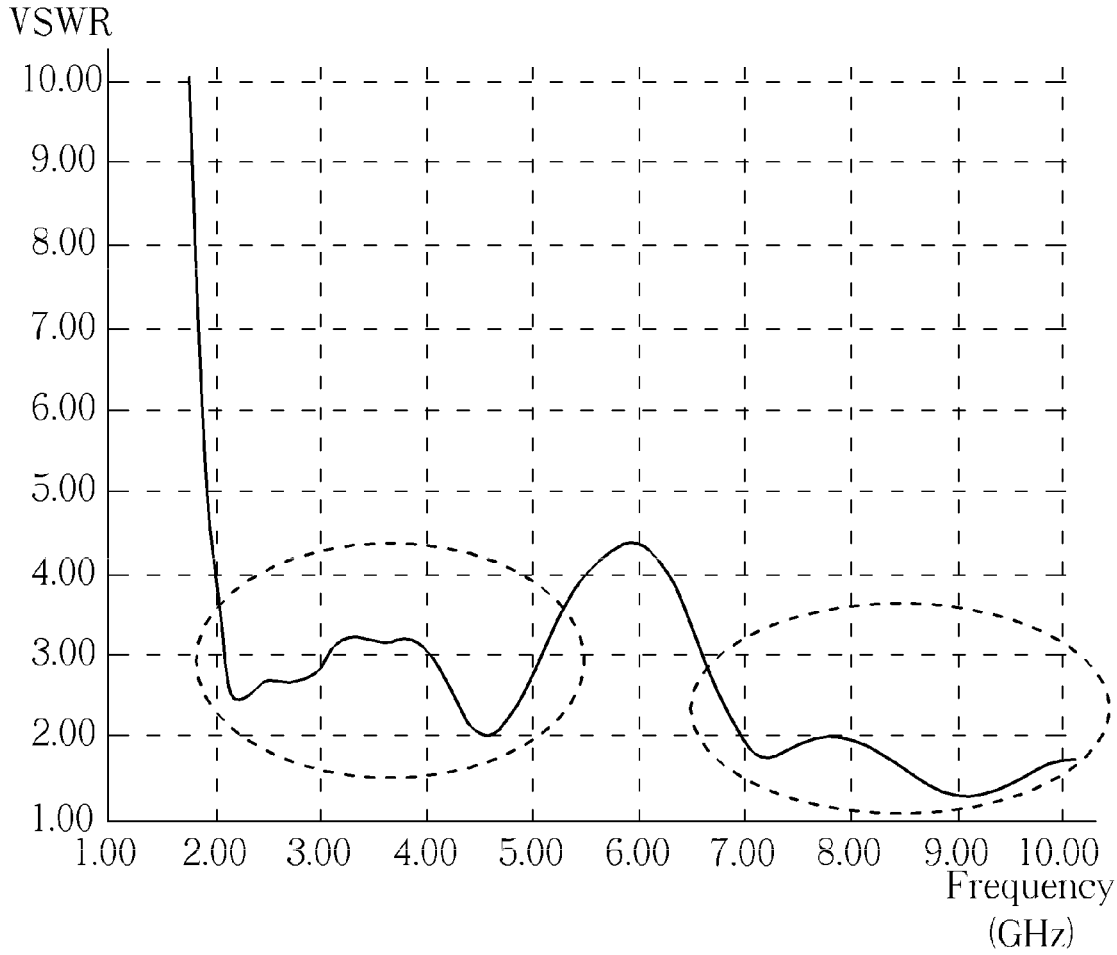
FIG. 7 is a diagram illustrating the simulating results of the VSWR of the antenna structure shown in FIG. 6.
Figure 8:
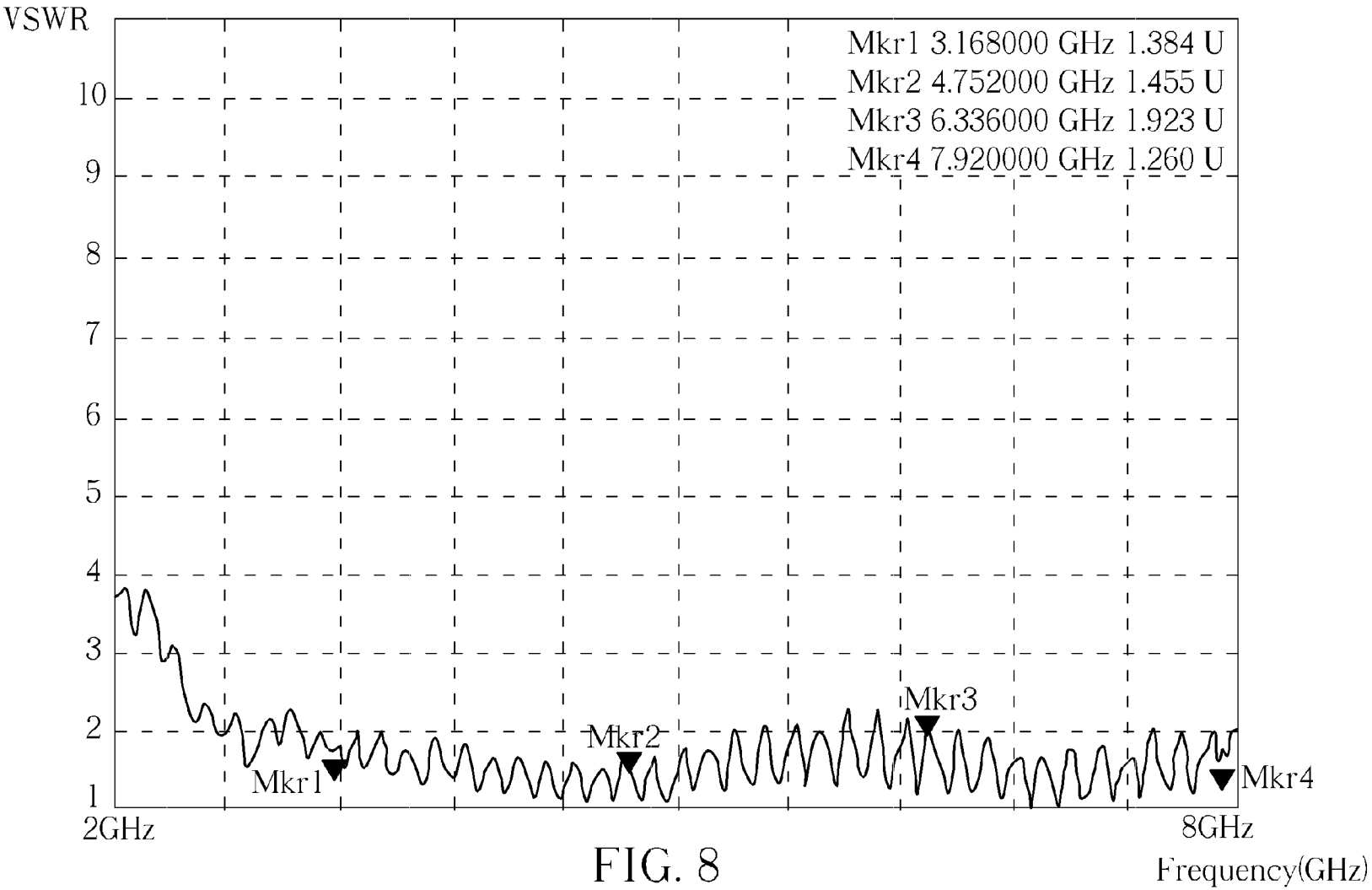
FIG. 8 is a diagram illustrating the measuring results of the VSWR of the antenna structure shown in FIG. 6.

Please refer to FIG. 7 together with FIG. 8. FIG. 7 is a diagram illustrating the simulating results of the VSWR of the antenna structure 600 shown in FIG. 6, and FIG. 8 is a diagram illustrating the measuring results of the VSWR of the antenna structure 600 shown in FIG. 6. The horizontal axis represents frequency (GHz), between 1 GHz and 10 GHz, and the vertical axis represents the VSWR. As can be known from FIG. 7 and FIG. 8, the measuring results of the VSWR of the antenna structure 600 is consistent with its simulating results of the VSWR. The antenna structure 600 has a first operating frequency band falling from about 3.168 GHz to 4.572 GHz (located between signs Mkr1 and Mkr2), and a second operating frequency band falling from about 6.336 GHz to 7.92 GHz (located between signs Mkr3 and Mkr4). In other words, the frequency bandwidth/frequency band of the antenna can be increased by bending the connection element.

Figure 9:
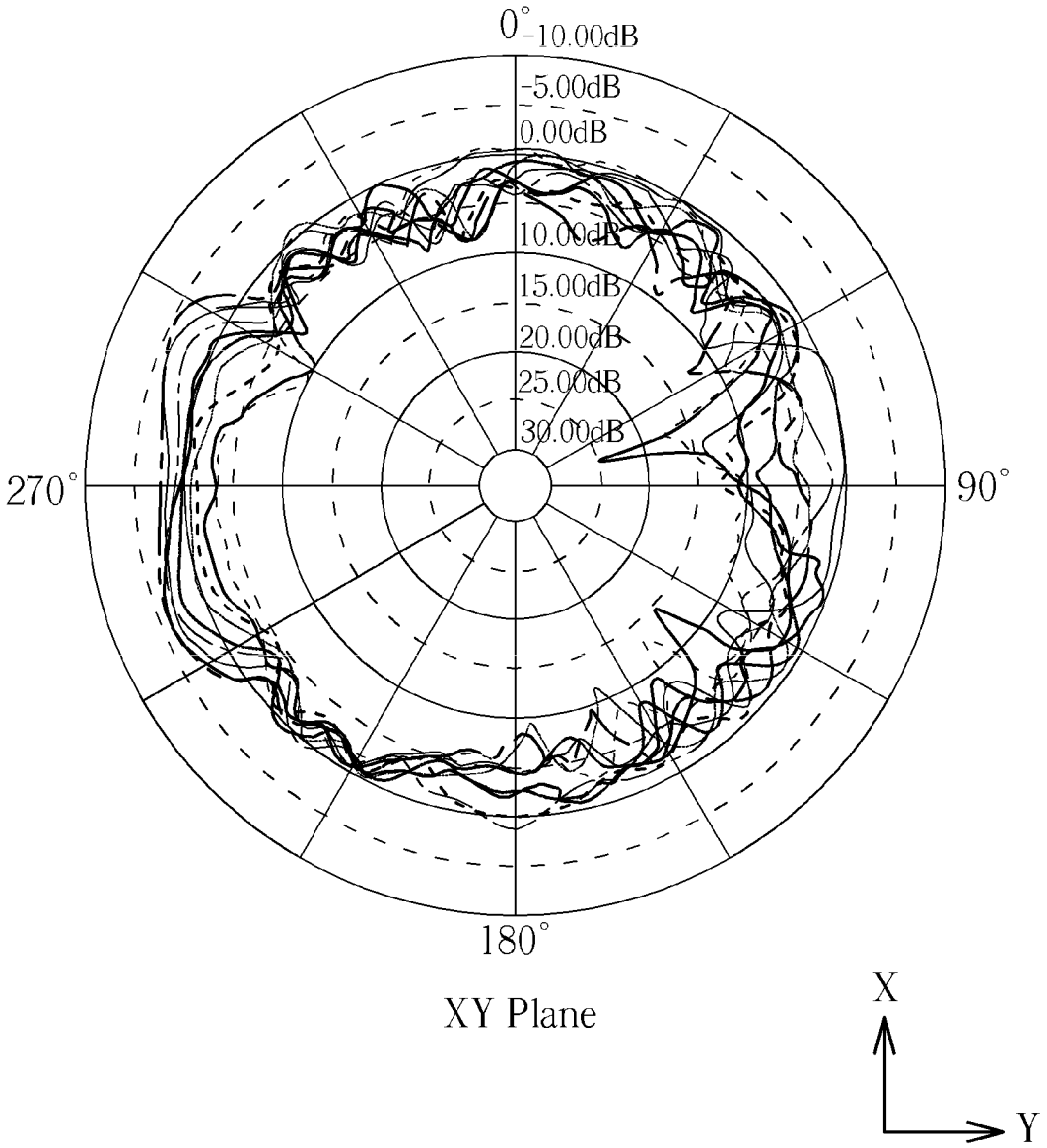
FIG. 9 is a diagram illustrating a radiation pattern of the antenna structure shown in FIG. 6.

Please refer to FIG. 9 together with FIG. 10. FIG. 9 is a diagram showing the measurement results of the antenna structure 600 in the XY plane, and the frequency band of the antenna structure 600 is shown in FIG. 8. FIG. 10 is a diagram showing the positions and the values of the maximum values, the minimum values, as well as the average values in FIG. 9. As can be known from the measurement results, the average values of the antenna structure 600 in the XY plane are very high.

Figure 11:
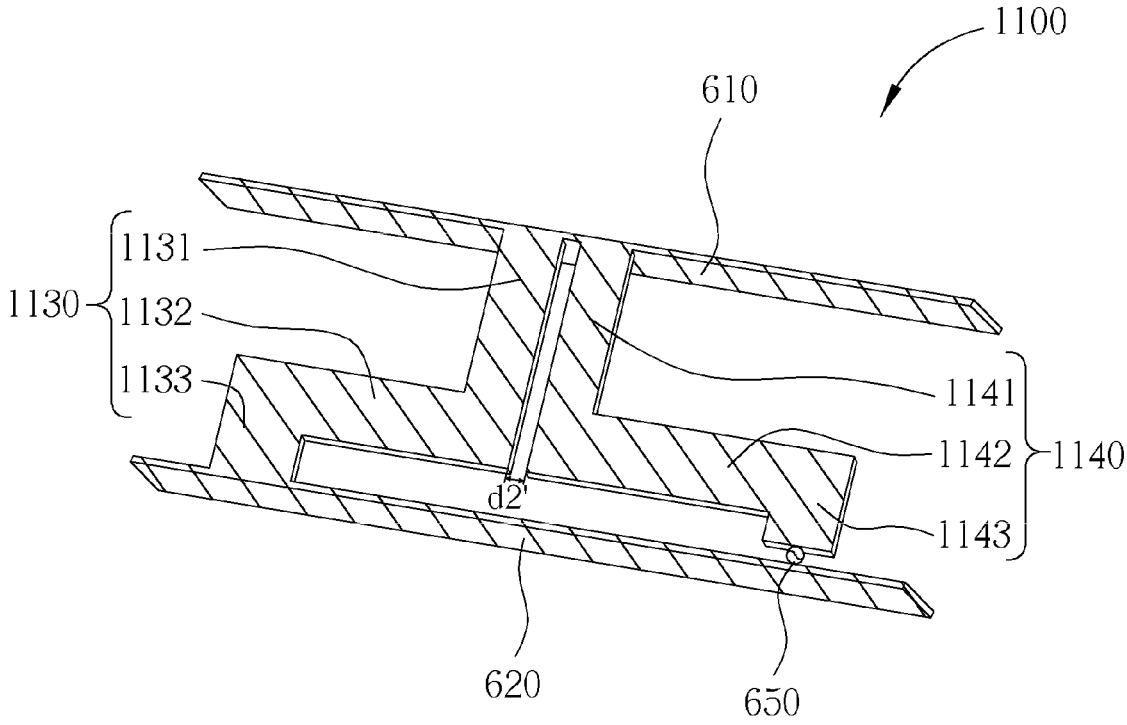
FIG. 11 is a diagram of an antenna structure according to a sixth embodiment of the present invention.

Please refer to FIG. 11. FIG. 11 is a diagram of an antenna structure 1100 according to a sixth embodiment of the present invention, which is a changed form of the antenna structure 600 shown in FIG. 6. In FIG. 11, the architecture of the antenna structure 1100 is similar to that of the antenna structure 600, and the difference between them is that the directions of a connection element 1140 (including segments 1141~1143) and a short element 1130 (including segments 1131~1133) included by the antenna structure 1100 are opposite to that of the connection element 640 and the short element 630 included by the antenna structure 600 shown in FIG. 6. In this embodiment, the segment 1141 of the connection element 1140 is substantially parallel to the segment 1131 of the short element 1130, and is at a designated distance d2' from the segment 1131, wherein the designated distance d2' is smaller than the aforementioned designated distance d2 (i.e., d2'<d2).

Figure 12:
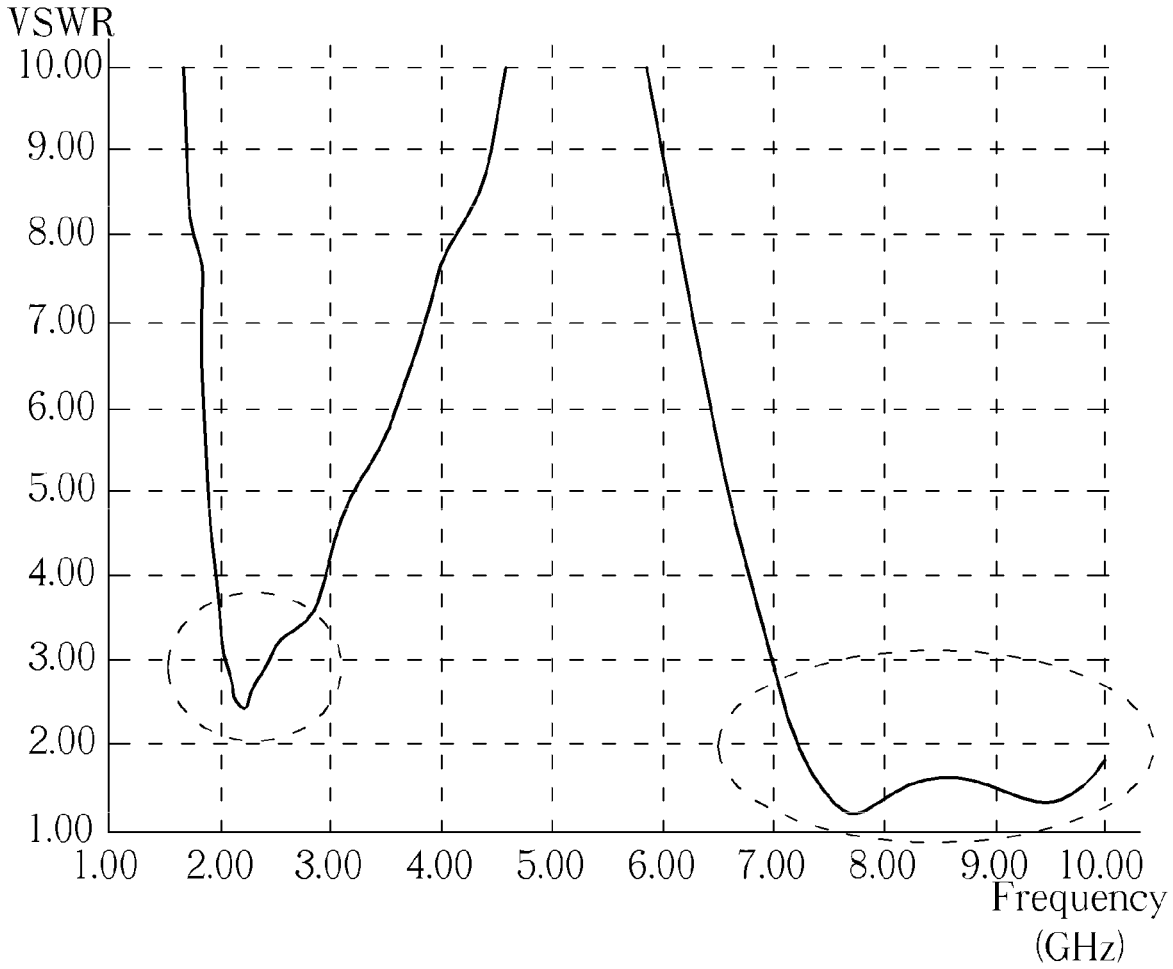
FIG. 12 is a diagram illustrating the VSWR of the antenna structure shown in FIG. 11.

Please refer to FIG. 12. FIG. 12 is a diagram illustrating the VSWR of the antenna structure 1100 shown in FIG. 11. The horizontal axis represents frequency (GHz), between 1 GHz and 10 GHz, and the vertical axis represents the VSWR. As can be known from FIG. 12, the antenna structure 1100 still has the feature of wideband. That is, the bending directions of the connection element and the short element should not be considered as a limitation of the present invention. Those skilled in the art should appreciate that various modifications of the bending directions of the connection element and the short element may be made without departing from the spirit of the present invention.

Figure 13:
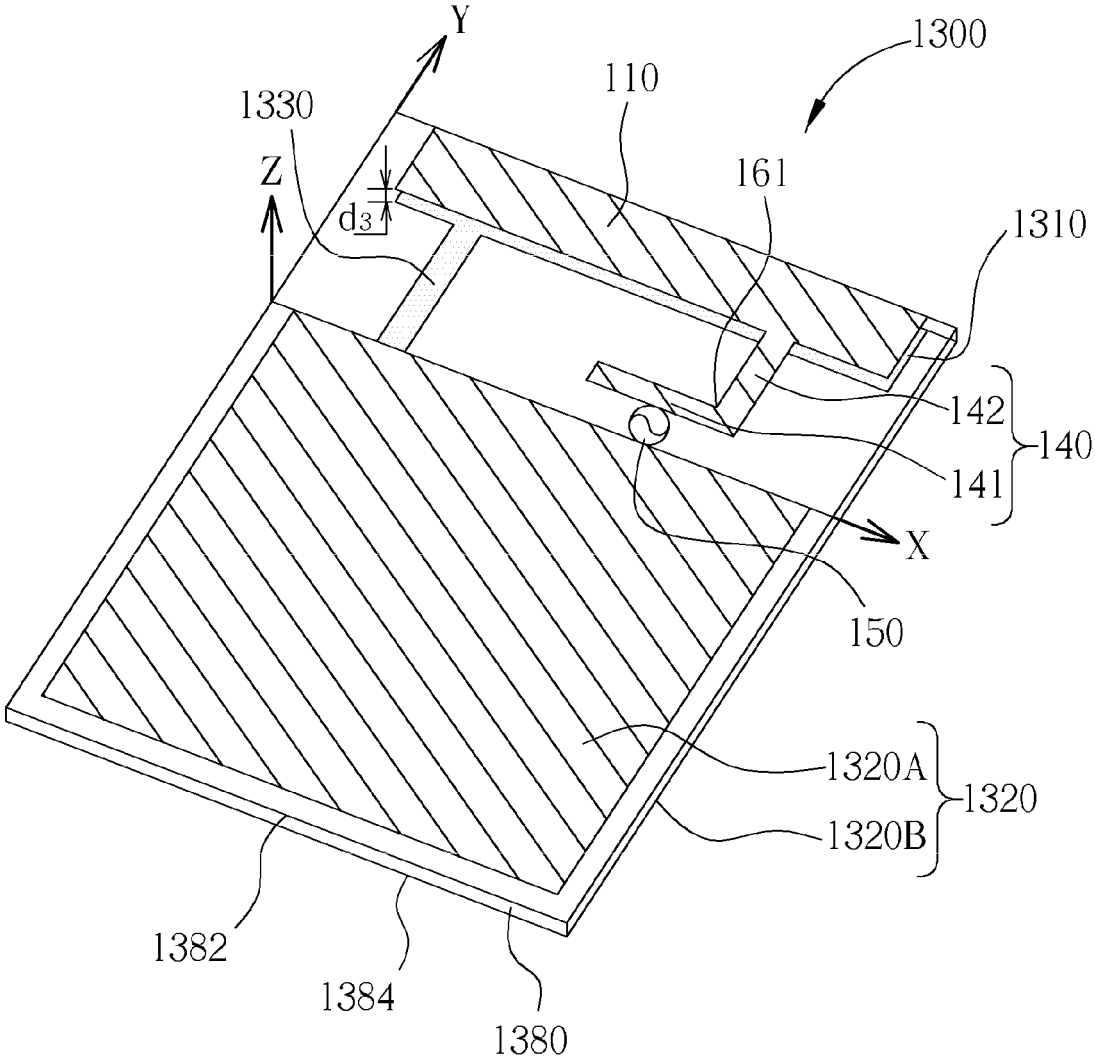
FIG. 13 is a top view diagram of an antenna structure according to a seventh embodiment of the present invention.
Figure 14:
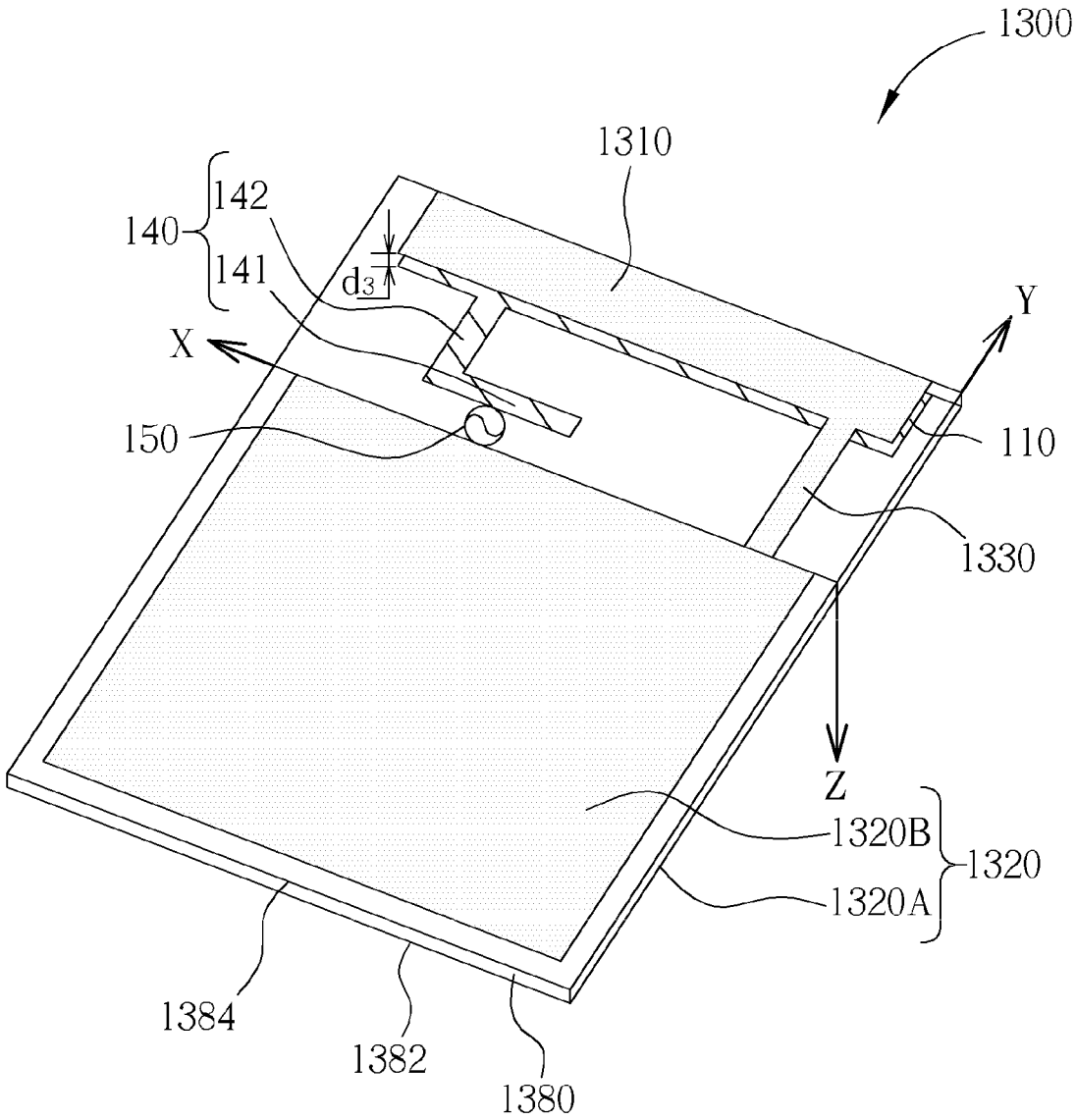
FIG. 14 is a back view diagram of the antenna structure shown in FIG. 13.

Please refer to FIG. 13 together with FIG. 14. FIG. 13 is a top view diagram of an antenna structure 1300 according to a seventh embodiment of the present invention, while FIG. 14 is a back view diagram of the antenna structure 1300 shown in FIG. 13. In FIG. 13, the architecture of the antenna structure 1300 is similar to that of the antenna structure 100. The difference between them is that the antenna structure 1300 further consists of a coupling element 1310 coupled to a short element 1330, wherein the short element 1330 is further coupled to a second grounding sub-element 1320B of a grounding element 1320. The coupling element 1310 partially overlaps the radiation element 110 and is at a designated distance d3 from the radiation element 110 in a designated direction, so as to have electromagnetic coupling effects. In this embodiment, the radiation element 110 is located on a first plane 1382 parallel to the XY plane, while the coupling element 1310 is located on a second plane 1384 parallel to the XY plane, wherein the coupling element 1310 is at the designated distance d3 from the radiation element 110 in the Z axis. As can be seen from FIG. 13 and FIG. 14, the coupling element 1310 is substantially parallel to the radiation element 110 to form an overlapped region. In other words, the radiation element 110 can be coupled to another plane (i.e., the plane on which the coupling element 1310 is located—the second plane 1384) by utilizing the coupling element 1310 collocating with the electromagnetic coupling effects, rather than be directly coupled to the short element 1330.

Please note that, in this embodiment, the grounding element 1320 consists of a first grounding sub-element 1320A as well as a second grounding sub-element 1320B, wherein the first grounding sub-element 1320A partially overlaps the second grounding sub-element 1320B and is at the designated distance from the second grounding sub-element 1320B in the designated direction. That is, the first grounding sub-element 1320A is at the designated distance d3 from the second grounding sub-element 1320B in the Z axis. As can be known from FIG. 13 and FIG. 14, the antenna structure 1300 consists of three layers: a dielectric layer 1380, a first metal layer, and a second metal layer. The dielectric layer 1380 has the first plane 1382 and the second plane 1384 opposite to the first plane 1382. The first metal layer is disposed on the first plane 1382 of the dielectric layer 1380 to form the first grounding sub-element 1320A and the radiation element 110. The second metal layer is disposed on the second plane 1384 of the dielectric layer 1380 to form the second grounding sub-element 1320B, the short element 1330, and the coupling element 1310. That is, the first grounding sub-element 1320A is coupled to the signal feeding element 150, and the first grounding sub-element 1320A, the radiation element 110, as well as the signal feeding element 150 are located on the first plane 1382 of the dielectric layer 1380, as is shown in FIG. 13. The second grounding sub-element 1320B is coupled to the short element 1330, and the second grounding sub-element 1320B, the coupling element 1310, as well as the short element 1330 are located on the second plane 1384 of the dielectric layer 1380, as is shown in FIG. 14.

In this embodiment, the short element 1330 and the connection element 140 are separately disposed on different locations of different planes, but this is not a limitation of the present invention. In other embodiments, the short element 1330 and the connection element 140 can overlap to each other and can be disposed on the same location of different planes, that is, the short element 1330 is at the designated distance from the connection element 140 in the designated direction. This should also belong to the scope of the present invention. In addition, the antenna structure 1300 can be designed by adopting a printed circuit board (PCB). The dielectric layer 1380 can be constructed by materials consisting of PTFE or glass fiber/Epoxy resin, and the first metal layer as well as the second metal layer can be constructed by materials consisting of aluminum or copper. But the present invention is not limited to this only and other materials might be adopted to design the antenna structure 1300.

Please note that the aforementioned designated distance d3 is not limited, as long as the electromagnetic coupling effects can be achieved. Moreover, in this embodiment, the shape and the size of the coupling element 1310 are totally identical to that of the radiation element 110. Those skilled in the art should appreciate that the shape and the size of the coupling element 1310 should not be considered as a limitation of the present invention, as long as the electromagnetic coupling effects can be achieved.

The abovementioned embodiments are presented merely to illustrate practicable designs of the present invention, and in no way should be considered to be limitations of the scope of the present invention. Those skilled in the art should appreciate that various modifications of the antenna structures shown in FIG. 1-FIG. 14 may be made without departing from the spirit of the present invention. For example, the antenna structures shown in FIG. 1-FIG. 14 can be arranged or combined randomly into a new varied embodiment.

From the above descriptions, the present invention provides the antenna structures 100-1300, which can achieve the goal of increasing its frequency bandwidth/frequency band by bending a connection element of the antenna structure. Therefore, the frequency bandwidth/frequency band can be increased without disposing an extra radiator, and both the size and the cost of the antenna can be effectively controlled. Furthermore, by changing the bending shape and the number of the bends included by the connection element and/or the short element of the antenna structure, the antenna structure is still provided with the feature of increasing frequency bandwidth/frequency band. Additionally, the average values and the antenna efficiency of the antenna structure disclosed in the present invention are very good.

Those skilled in the art will readily observe that numerous modifications and alterations of the device and method may be made while retaining the teachings of the invention.

What is claimed is:

1. An antenna structure, comprising:
- a radiation element;
- a grounding element;
- a short element, disposed between the radiation element and the grounding element;
- a coupling element, coupled to the short element, wherein the coupling element partially overlaps the radiation element and is at a designated distance from the radiation element in a designated direction;
- a connection element, disposed between the radiation element and the grounding element, the connection element comprising at least a first segment and a second segment, wherein the first segment and the second segment form a bend; and
- a signal feeding element, coupled between the connection element and the grounding element.

2. The antenna structure of claim 1, wherein the short element is coupled to the radiation element and the grounding element.

3. The antenna structure of claim 1, wherein the first segment of the connection element is substantially parallel to the grounding element.

4. The antenna structure of claim 3, wherein the first segment of the connection element is at a distance of approximately 1.0~2.5 mm from the grounding element.

5. The antenna structure of claim 1, wherein the connection element further comprises a third segment, and the first segment, the second segment, and the third segment form a plurality of bends.

6. The antenna structure of claim 1, wherein the short element comprises a plurality of segments, and the plurality of segments form at least one bend.

7. The antenna structure of claim 1, wherein the radiation element, the grounding element, the short element, the connection element, and the signal feeding element are located on an identical plane.

8. The antenna structure of claim 1, wherein at least a plurality of elements among the radiation element, the grounding element, the short element, the connection element, and the signal feeding element are located on different planes.

9. The antenna structure of claim 1, wherein the coupling element is substantially parallel to the radiation element.

10. The antenna structure of claim 1, wherein the grounding element comprises a first grounding sub-element and a second grounding sub-element, and the first grounding sub-element partially overlaps the second grounding sub-element and is at the designated distance from the second grounding sub-element in the designated direction; the first grounding sub-element is coupled to the signal feeding element, and the first grounding sub-element, the radiation element, as well as the signal feeding element are located on a first plane; and the second grounding sub-element is coupled to the short element, and the second grounding sub-element, the coupling element, as well as the short element are located on a second plane different from the first plane.

11. The antenna structure of claim 10, further comprising:

a dielectric layer, having the first plane and the second plane opposite to the first plane;

a first metal layer, disposed on the first plane of the dielectric layer to form the first grounding sub-element and the radiation element; and a second metal layer, disposed on the second plane of the dielectric layer to form the second grounding sub-element, the short element, and the coupling element.

12. An antenna structure, comprising:

a radiation element;

a grounding element;

a short element, disposed between the radiation element and the grounding element;

a coupling element, coupled to the short element, wherein the coupling element partially overlaps the radiation element and is at a designated distance from the radiation element in a designated direction;

a connection element, disposed between the radiation element and the grounding element, the connection element comprising a plurality of segments forming a lightning shape, wherein a first segment among the plurality of segments is at a distance of 1.0~2.5 mm from the grounding element; and a signal feeding element, coupled between the connection element and the grounding element.

13. The antenna structure of claim 12, wherein the short element is coupled to the radiation element and the grounding element.

14. The antenna structure of claim 12, wherein the first segment of the connection element is substantially parallel to the grounding element.

15. The antenna structure of claim 12, wherein the short element comprises a plurality of segments, and the plurality of segments form at least one bend.

16. The antenna structure of claim 12, wherein the radiation element, the grounding element, the short element, the connection element, and the signal feeding element are located on an identical plane.

17. The antenna structure of claim 12, wherein at least a plurality of elements among the radiation element, the grounding element, the short element, the connection element, and the signal feeding element are located on different planes.

18. The antenna structure of claim 12, wherein the coupling element is substantially parallel to the radiation element.

19. The antenna structure of claim 12, wherein the grounding element comprises a first grounding sub-element and a second grounding sub-element, and the first grounding sub-element partially overlaps the second grounding sub-element and is at the designated distance from the second grounding sub-element in the designated direction; the first grounding sub-element is coupled to the signal feeding element, and the first grounding sub-element, the radiation element, as well as the signal feeding element are located on a first plane; and the second grounding sub-element is coupled to the short element, and the second grounding sub-element, the coupling element, as well as the short element are located on a second plane different from the first plane.

20. The antenna structure of claim 19, further comprising:

a dielectric layer, having the first plane and the second plane opposite to the first plane;

a first metal layer, disposed on the first plane of the dielectric layer to form the first grounding sub-element and the radiation element; and a second metal layer, disposed on the second plane of the dielectric layer to form the second grounding sub-element, the short element, and the coupling element.

21. An antenna structure, comprising:

a radiation element;

a first grounding sub-element;

a second grounding sub-element;

a coupling element, partially overlapping the radiation element and being at a designated distance from the radiation element in a designated direction to have electromagnetic coupling effects;

a connection element, coupled to the radiation element, the connection element comprising at least a first segment and a second segment, wherein the first segment and the second segment form a bend;

a short element, coupled between the coupling element and the second grounding sub-element; and a signal feeding element, coupled between the connection element and the first grounding sub-element.

* * * * *